US009587409B2

(12) United States Patent
Bair

(10) Patent No.: US 9,587,409 B2
(45) Date of Patent: Mar. 7, 2017

(54) FLOATING POOL SKIMMER

(71) Applicant: Ronald Bair, Mill Hall, PA (US)

(72) Inventor: Ronald Bair, Mill Hall, PA (US)

( * ) Notice: Subject to any disclaimer, the term of this patent is extended or adjusted under 35 U.S.C. 154(b) by 12 days.

(21) Appl. No.: 14/804,583

(22) Filed: Jul. 21, 2015

(65) Prior Publication Data

US 2016/0024810 A1 Jan. 28, 2016

Related U.S. Application Data

(60) Provisional application No. 62/028,869, filed on Jul. 25, 2014, provisional application No. 62/144,492, filed on Apr. 8, 2015.

(51) Int. Cl.
*E04H 4/12* (2006.01)
*E04H 4/16* (2006.01)

(52) U.S. Cl.
CPC ..... *E04H 4/1263* (2013.01); *E04H 4/1609* (2013.01)

(58) Field of Classification Search
CPC ..... E04H 4/1263; E04H 4/1609
USPC ..... 210/167, 167.1, 167.19, 167.2, 242.1
See application file for complete search history.

(56) References Cited

U.S. PATENT DOCUMENTS 3,188,668 A 6/1965 Buckelew
3,931,740 A 1/1976 Carter
4,053,412 A 10/1977 Stix
4,089,074 A 5/1978 Sermons
4,198,720 A 4/1980 Matsumoto
4,518,495 A 5/1985 Harding
4,724,566 A 2/1988 Fawcett
4,820,411 A 4/1989 Lempio
5,043,060 A 8/1991 Brennan
5,085,767 A 2/1992 Beers
5,137,623 A 8/1992 Wall et al.
5,223,135 A 6/1993 MacPhee et al.
5,350,508 A 9/1994 Van der Watt
5,454,940 A 10/1995 Lakotish
5,614,085 A 3/1997 Platt, III
5,705,058 A 1/1998 Fischer
5,759,388 A * 6/1998 Cote ..... B01D 29/15 210/167.2
5,911,878 A 6/1999 Benvenuto et al.
5,926,891 A 7/1999 Velasquez
6,132,604 A 10/2000 Kirchoff
6,270,683 B1 8/2001 Turner
6,358,410 B1 3/2002 Lambert
6,383,374 B1 5/2002 Splendorio
6,668,413 B2 12/2003 Fortier
7,033,490 B2 4/2006 Blackman et al.
7,101,475 B1 9/2006 Maaske
7,504,025 B2 3/2009 Burgassi
7,603,836 B2 10/2009 Grosjean
7,758,748 B2 7/2010 Bogdanov et al.
7,972,504 B2 7/2011 Weiss
7,984,811 B2 7/2011 Gonzalez
2004/0108259 A1 6/2004 Giannantonio
(Continued)

*Primary Examiner* — Fred Prince
(74) *Attorney, Agent, or Firm* — Picadio Sneath Miller & Norton, P.C.; Robert L. Wagner

(57) ABSTRACT

An invention for cleaning the surface and near surface of pools and ponds is disclosed. The invention comprises a floating skimmer with a screening medium that can easily be controlled by an operator and maneuvered above and below the surface of the pool or attached to the side of the pool.

27 Claims, 9 Drawing Sheets

(56) References Cited

U.S. PATENT DOCUMENTS

| | | | |
|---|---|---|---|
| 2005/0087483 | A1 | 4/2005 | Clay |
| 2005/0126969 | A1 | 6/2005 | Dolton, III |
| 2006/0060513 | A1 | 3/2006 | Craig |
| 2006/0096905 | A1 | 5/2006 | Burgassi |
| 2012/0305461 | A1 | 12/2012 | Veronie |
| 2012/0305465 | A1 | 12/2012 | Eichler |
| 2013/0025626 | A1 | 1/2013 | Resh |

* cited by examiner

FLOATING POOL SKIMMER

RELATED APPLICATION

This application claims the benefit of co-pending U.S. Provisional Patent Application No. 62/028,869, filed on Jul. 25, 2014, and co-pending U.S. Provisional Patent Application No. 62/144,492, filed on Apr. 8, 2015, the contents of both are hereby incorporated by reference.

FIELD OF THE INVENTION

The present invention generally relates to an apparatus for cleaning the surface and interior sides of a pool. More specifically, this invention relates to a floating, portable skimming device that can be readily moved across or below the surface of a pool or attached to the side of a pool.

BACKGROUND OF THE INVENTION

Outdoor swimming pools and decorative ponds are common features in backyards, parks, schools, camps, and clubs throughout the country. Because they are outside, the surface of these pools can become cluttered or contaminated with various kinds of debris, such as leaves, dirt, insects, and sticks, among many other things. This debris mars the aesthetics of the pool, can cause health issues to those who swim in the pool, and can interfere with the pumps and filters that clean the pool. In addition, this debris can stick to the interior sides of the pool and mar their appearance. As a result, it is desirable to clean the surface and sides of the pool. In particular, it is desirable to clean these surfaces and sides without an individual having to physically enter the pool.

Various means exist to clean these surfaces, which range from manual, hand skimmers to powered devices. One of the most common devices is a net attached to the end of a pole. An individual can manually move this skimming net across the surface of the pool in order to collect the debris. This method is not without its drawbacks, however. For instance, it is a slow and cumbersome process. It also requires physical effort to move the net on top of the surface, because the operator must support the entire weight of the pole, net, and debris during use. Also, the pole must be regularly removed and emptied because the net's capacity is limited and the debris can easily fall out of the net once it is collected.

Powered devices, either using electrical, solar, or wind power, can be used to autonomously clean the pool. These devices are typically placed in the pool and left to clean the pool without human intervention. Either wind or jets/propellers move the device in random or pre-set patterns. These devices also have drawbacks, though. For instance, they can be expensive, especially if they contain sophisticated electronics or motors. They also can miss debris in the pool, especially if they randomly move across the surface to clean the pool or are otherwise not controllable by the operator.

Another approach has been to use devices pulled by ropes across the surface of the pool, but these devices can be cumbersome to maneuver and cannot be used to collect debris that is floating below the surface of the pool because of the inability to pull the devices down with enough force to overcome the buoyancy of the device.

Thus, there exists a need for an inexpensive, easy to control device that can quickly and efficiently clean the surface, near surface, and sides of a pool or pond.

SUMMARY OF THE INVENTION

The present invention addresses these issues by providing a simple and easily-controllable skimming device that allows an operator to clean the surface, near surface, and sides of a pool, pond, or other water-retaining body. The skimming device floats on the surface of the water, which reduces the weight that must be borne by operator during its use. However, it is weighted and balanced such that some embodiments of the invention can be easily submerged by an operator in order to collect debris that is floating beneath the surface of water, but will naturally try to return to the surface. The front-to-back balancing of the buoyancy of the skimming device is such that the back end of some embodiments will be more inclined to remain floating on or nearer to the surface of the water when the operator tries to submerge the device. In other embodiments, a sinker bar is placed on the front end of the skimming device to facilitate the front end of the skimming device dipping below the water line when water flows past the device. These features assist in collecting and retaining any debris.

Embodiments of the invention can have large collection areas, which reduces the need for repeatedly emptying the skimmer of debris. For many pools, the entire pool can be cleaned without having to remove the skimmer from the pool or to empty it until the cleaning is complete. Embodiments of the invention have a control mechanism that allows the operator to easily control the movement of the device when it is in the water. Embodiments of the present invention can also be used in a fixed position on the side of a pool, in addition to being controlled by an operator.

While the discussions of some of the embodiments of the invention that follow are in the context of cleaning a swimming pool, the invention has broader uses and the term pool is meant to be a general term encompassing swimming pools, ornamental ponds, fish ponds, and other bodies of water that one desires to clean.

In one embodiment, an apparatus for collecting debris near a surface of a pool, comprising: a first side with a first front end and a first back end; a second side with a second front end and a second back end, wherein the second side is generally parallel to the first side; a front cross piece extending from the first front end to the second front end; a back cross piece extending from the first back end to the second back end; a flexible cord with a first cord end and a second cord end, wherein the first cord end is connected to the first side at a first cord attachment point that is closer to the first front end than the first back end and wherein the second cord end is connected to the second side at a second cord attachment point that is closer to the second front end than the second back end and wherein the length of the flexible cord is less than three times the distance between the first side and the second side; an apparatus front end comprised of a front portion of the apparatus extending between the first and second front ends and the first and second cord attachment points; an apparatus back end comprised of a back portion of the apparatus extending between the first and second cord attachment points and the first and second back ends; a first elongated floatation device extending from the apparatus front end to the apparatus back end; a second elongated floatation device extending from the apparatus front end to the apparatus back end; a first screening medium extending from the apparatus front end to the apparatus back end; a control attachment point located on the flexible cord; and wherein the buoyancy of the apparatus front end is less than the buoyancy of the apparatus back end.

In another embodiment, an apparatus for collecting debris near a surface of a pool, comprising: a first side with a first front end and a first back end; a second side with a second front end and a second back end, wherein the second side is generally parallel to the first side; a front cross piece extending from the first front end to the second front end; a back cross piece extending from the first back end to the second back end; a flexible cord with a first cord end and a second cord end, wherein the first cord end is connected to the first side at a first cord attachment point that is closer to the first front end than the first back end and wherein the second cord end is connected to the second side at a second cord attachment point that is closer to the second front end than the second back end and wherein the length of the flexible cord is less than three times the distance between the first side and the second side; an apparatus front end comprised of a front portion of the apparatus extending between the first and second front ends and the first and second cord attachment points; an apparatus back end comprised of a back portion of the apparatus extending between the first and second cord attachment points and the first and second back ends; a first elongated floatation device extending from the apparatus front end to the apparatus back end; a second elongated floatation device extending from the apparatus front end to the apparatus back end; a first screening medium extending from the apparatus front end to the apparatus back end; a control attachment point located on flexible cord; a sinker bar parallel to the front cross piece and connected to the apparatus front end; and wherein the buoyancy of the apparatus front end is less than the buoyancy of the apparatus back end.

In still another embodiment, an apparatus for collecting debris near a surface of a pool, comprising: a first side with a first front end and a first back end; a second side with a second front end and a second back end, wherein the second side is generally parallel to the first side; a front cross piece extending from the first front end to the second front end; a back cross piece extending from the first back end to the second back end; a flexible cord with a first cord end and a second cord end, wherein the first cord end is connected to the first side at a first cord attachment point that is closer to the first front end than the first back end and wherein the second cord end is connected to the second side at a second cord attachment point that is closer to the second front end than the second back end and wherein the length of the flexible cord is less than three times the distance between the first side and the second side; an apparatus front end comprised of a front portion of the apparatus extending between the first and second front ends and the first and second cord attachment points; an apparatus back end comprised of a back portion of the apparatus extending between the first and second cord attachment points and the first and second back ends; a first elongated floatation device extending from the apparatus front end to the apparatus back end; a second elongated floatation device extending from the apparatus front end to the apparatus back end; a first screening medium extending from the apparatus front end to the apparatus back end; a control attachment point located on the flexible cord; a second screening medium located at the apparatus back end, wherein the second screening medium is generally parallel to the back cross piece; and wherein the buoyancy of the apparatus front end is less than the buoyancy of the apparatus back end.

In yet another embodiment, an apparatus for collecting debris near a surface of a pool, comprising: a first side with a first front end and a first back end; a second side with a second front end and a second back end, wherein the second side is generally parallel to the first side; a front cross piece extending from the first front end to the second front end; a back cross piece extending from the first back end to the second back end; an apparatus front end comprised of the first front end, the second front end, and the front cross piece; an apparatus back end comprised of the first back end, the second back end, and the back cross piece; a first elongated floatation device extending from the apparatus front end to the apparatus back end; a second elongated floatation device extending from the apparatus front end to the apparatus back end; a first screening medium extending from the apparatus front end to the apparatus back end; a sinker bar parallel to the front cross piece and connected to the apparatus front end; a first attachment member connected to the first side; a second attachment member connected to the second side; and a bracket connected to the first attachment member and the second attachment member.

DETAILED DESCRIPTION

The following discussion describes the preferred embodiment of the invention and other embodiments, but there are many other possible embodiments of the invention that fall within the scope of the invention, and one of skill in the art would recognize the various alterations that would fall within the scope of the invention.

Figure 1:
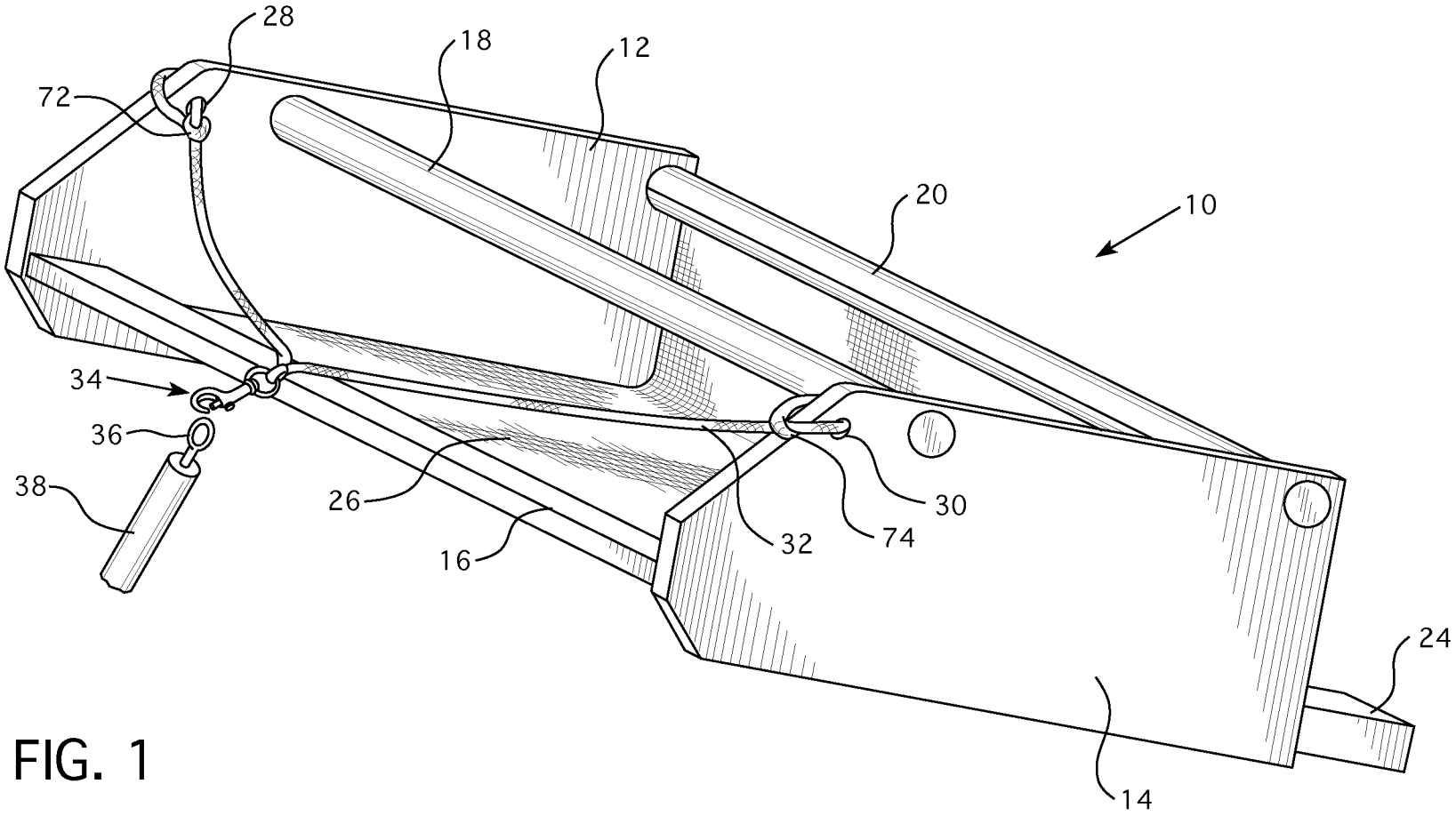
FIG. 1 is a perspective view of one embodiment of the invention.
Figure 2:
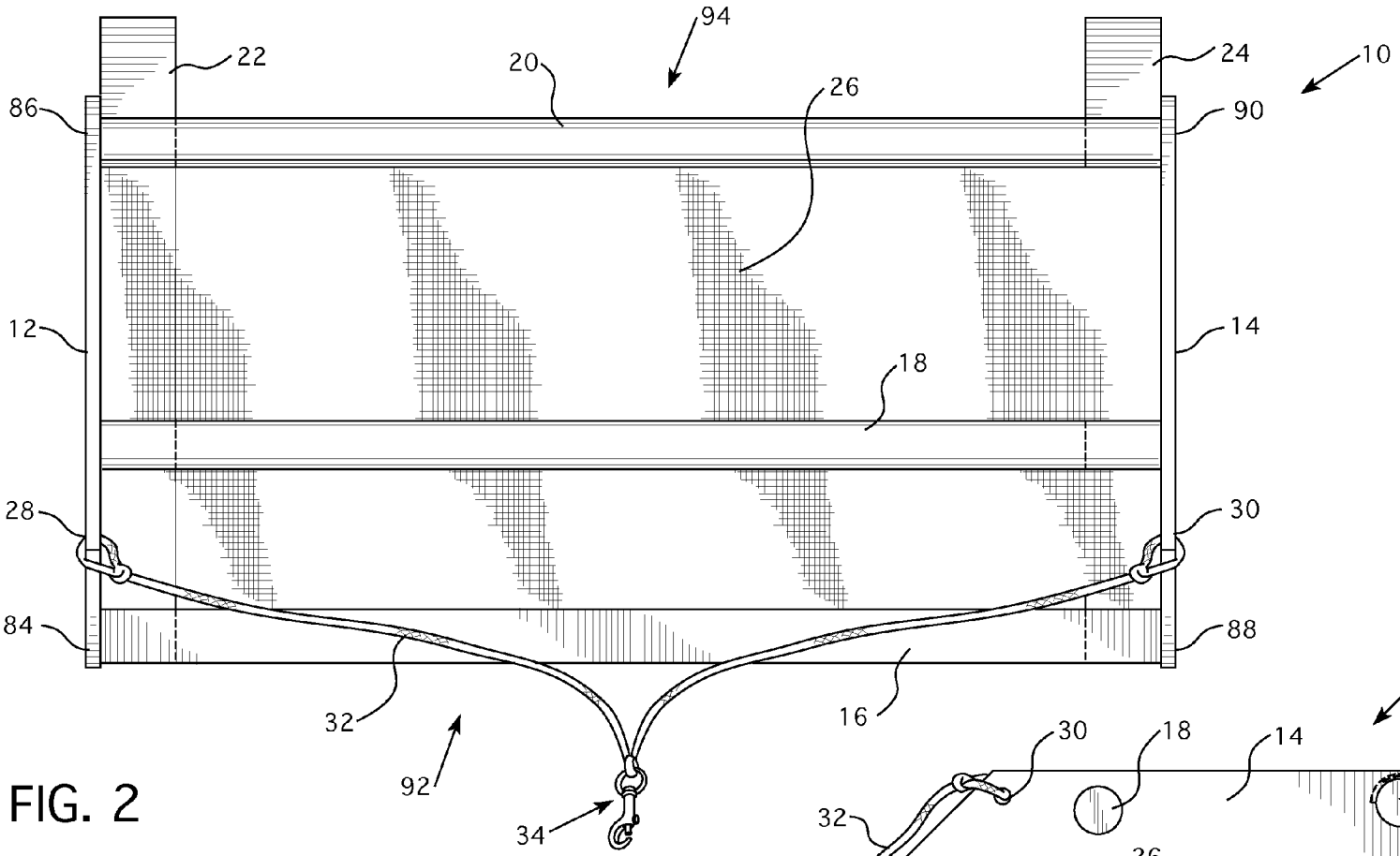
FIG. 2 is a top view of one embodiment of the invention.
Figure 3:
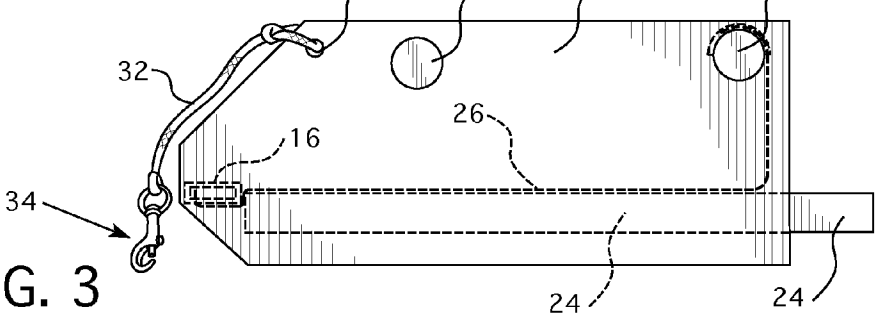
FIG. 3 is a side view of one embodiment of the invention.

In one embodiment, as shown in FIGS. 1-3, skimmer 10 is comprised of two generally rectangular wooden sides or side panels 12 and 14 that are approximately 5"×11"×0.75" (height×length×thickness) in size and are generally parallel to each other (which can encompass embodiments where the sides are exactly parallel to each other or are within 10° of being parallel to one another). These panels could also be made of metal, plastic, composites, or a variety of other different materials or combination of materials, and they can be in different shapes and sizes. Side panels 12 and 14 are connected via three wooden cross pieces—front cross piece 16, top cross piece 18, and back cross piece 20. Again, cross pieces 16, 18, and 20 can also be made of metal, plastic, composites, or a variety of other different materials or combination of materials, and they can have different cross sections, such as circular, square, rectangular, or hexagonal, among other things. Side panels 12 and 14 have front ends 84 and 88, which are the portions of the panels towards the front of each side panel (e.g., nearer front cross piece 16), and back ends 86 and 90, which are the portions of the panels towards the back of each side panel (e.g., nearer back cross piece 20).

Figure 15:
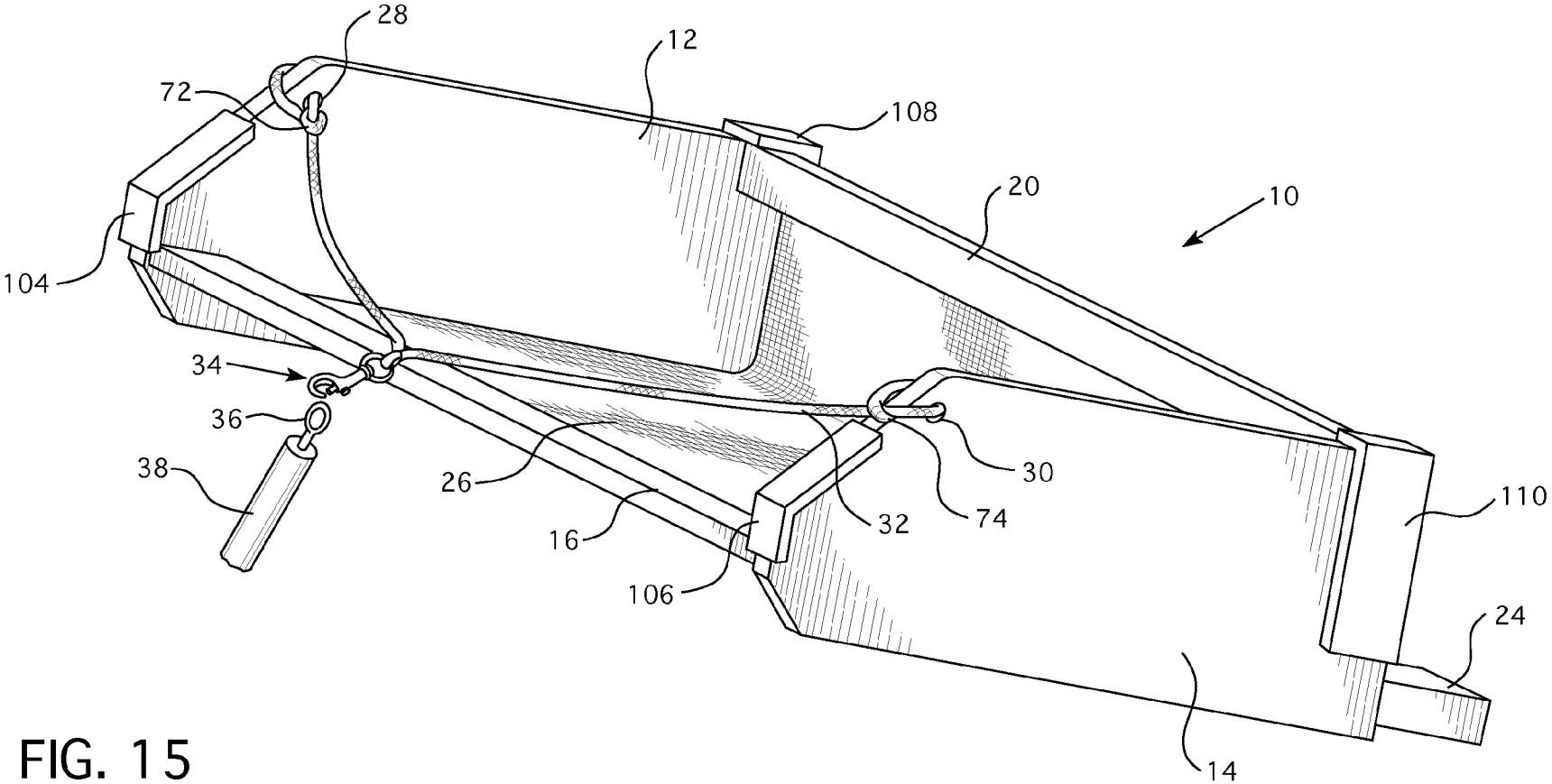
FIG. 15 is a perspective view of another embodiment of the invention.

Front cross piece 16 is roughly rectangular in cross section with dimensions of 0.75"×1.5"×22.5" (height×width×length). It is connected towards the lower front end of skimmer 10 and extends from one side panel to the other. Top cross piece 18 is cylindrical in shape with a radius of 0.75" and a length of 22.5". It is located towards the upper middle of skimmer 10 and extends from one side panel to the other. Back cross piece 20 is cylindrical in shape with a radius of 0.75" and a length of 22.5". It is located towards the upper back end of skimmer 10 and extends from one side panel to the other. While cross pieces 16, 18, and 20 are attached to side panels 12 and 14 via a connecting mechanism, such as a screw, nail, bolt, rivet, clip, or glue, for example, they could also be integral with one or both of sides 12 and 14. Cross pieces 16, 18, and 20 can be solid or hollow (in order to adjust the overall weight of skimmer 10 or to increase or decrease its buoyancy) or filled with a lightweight or buoyant material. Other numbers of cross pieces (such as 2, 4, 5, 6, 10, etc.) could also be used and fall within the scope of the invention. For example, top cross piece 18 could be removed from this embodiment, as shown in FIG. 15, or it could be moved to the back and below cross piece 20.

Skimmer 10 contains two wooden 0.75"×3.5"×13" (height×width×length) elongated flotation devices 22 and 24 connected to the bottom of side panels 12 and 14 and extend from the front of skimmer 10 to the back. It has been found that the optimal configuration for maneuverability and operation is such that flotation devices 22 and 24 should not extend beyond front cross piece 16, although the invention can still function if flotation devices 22 and 24 extend in front of front cross piece 16 or are configured in a different manner. Flotation devices 22 and 24 can be made from a variety of buoyant materials or combinations of buoyant materials, such as wood, cork, plastic, foams (e.g., polyvinyl chloride, polyethylene, and polystyrene), aerogels, nanocellulose, Styrofoam, and sealed air containers, among other things. Alternatively, floatation devices 22 and 24 could be integral with sides 12 and 14 (respectively), below sides 12 and 14 (respectively), or next to or beside sides 12 and 14 (respectively), among other things, and fall within the scope of the invention.

Floatation devices 22 and 24 are designed to keep skimmer 10 floating at the top of the water's surface 96 when it is in pool or pond 98. Thus, the operator does not have to support the weight of skimmer 10 while it is in pool 98. At the same time, the overall buoyancy of skimmer 10 is such that some or all of it can be submerged with relative ease should the operator push down on the front of skimmer 10 via pole 38 described below.

A 15"×22.5" (length×width) screening medium 26 in the form of a net runs along the bottom of skimmer 10 and is attached to cross pieces 16 and 20. Net 26 is also connected to sides 12 and 14, either by being directly attached to or abutting sides 12 and 14 or by being indirectly attached to another member (such as a frame or bar) that is attached or next to the sides. Because front cross piece 16 is in the lower front of skimmer 10 and back cross piece 20 is in the upper back of skimmer 10, debris that floats into skimmer 10 will generally become and remain trapped in skimmer 10 during operation. Net 26 can be attached to cross pieces 16 and 20 and sides 12 and 14 in a variety of manners, such as via glue, screws, nails, rivets, friction fits, clamps, glue, buttons, zippers, snaps, splines, or Velcro-type materials. In this particular embodiment, net 26 is attached to front cross piece 16 and back cross piece 20 by a rubber spline strip inserted into a groove in the cross pieces. Net 26 can be permanently attached to skimmer 10, or it can be removably attached in order to facilitate cleaning or repair of skimmer 10 or net 26. Net 26 can be made from a variety of materials, such as string, cord, plastic, polyethylene, polypropylene, polyester, nylon, or other types of polymer plastics. In this particular embodiment, net 26 is made of polyester. The mesh of the net should be small enough that the debris will remain trapped in net 26, but sufficiently porous enough so that it will allow the water to flow through the net during operation or removal of skimmer 10 from the water. In other embodiments, screening medium 26 could be a screen, a strainer, or other type of material that allows water to readily pass through while containing the debris to be removed.

In order to operate and direct the movement of skimmer 10 in pool or body of water 98, there are two cord attachment points 28 and 30 located in the top, front corners of side panels 12 and 14. In this embodiment, these cord attachment points are 0.3125" diameter holes offset by approximately 0.25" from the top front corners of side panels 12 and 14, but other forms and locations of attachment points could be used (such as an eyelet, loop, ring, clasp, screw, or hook, among other things). Cord ends 72 and 74 of a 0.25" diameter by 32" long flexible cord (or rope) 32 are connected to side panels 12 and 14 at cord attachment points 28 and 30. Flexible cord 32 can be made of other materials besides rope, such as chain, cord, or wire, among other things, and be of different diameters and lengths.

In order to control the operation of skimmer 10, pole 38 connects to skimmer 10 via control attachment point 34, which is located at roughly the middle (the mid-point) of rope 32, and, in this embodiment, is a spring-loaded clip fastened to rope 32. Control attachment point 34 can be variety of mechanisms or means on rope 32 and fall within the scope of the invention. For instance, control attachment point 34 could just be the middle of rope 32 that is grasped, tied to, or otherwise connected to or by coupling point 36 or pole 38. Control attachment point 34 could also be an eyelet, loop, ring, clasp, screw, hook, carabiner, or any of a number of devices or means on rope 32 by which pole 38 ultimately connects to rope 32. Control attachment point 34 could encompass multiple attachment points along rope 32, such as two or more points equally spaced along or from the middle of rope 32.

The ends of rope 32 are tied to cord attachment points 28 and 30 in order to secure the ends of rope 32 to side panels 12 and 14. Alternatively, other chemical or mechanical devices could be used to secure rope 32 to cord attachment points 28 and 30, such as clips, loops, screws, bolts, rivets, rings, staples, clasps, ferrules, glues, and other chemical means, among many other things. In addition, control attachment point 34 could also take other forms, such as a loop, screw, eyebolt, ring, clasp, eyelet, hook, etc. Cord attachment points 28 and 30 should be located in the front half of skimmer 10 in order to facilitate movement of skimmer 10, but can be located in different positions than those shown in FIGS. 1-3 and still fall within the scope of the invention.

In this embodiment, pole 38 connects to control attachment point 34 via coupling point 36. In one embodiment, pole 38 is a 15' long by 1" diameter aluminum pole with a handle on the opposite end from coupling point 36. Coupling point 36 is an eyebolt attached to the end of pole 38, which allows pole 38 to attach to rope 32 (and, therefore, skimmer 10) via control attachment point 34. Alternatively, coupling point 36 could take other forms, such as a hole, loop, clip, or other mechanism attached to or in pole 38. Using a spring-loaded clip for control attachment point 34 allows skimmer 10 to be easily decoupled from coupling point 36/pole 38 for storage, repair, or replacement purposes (for example, to connect a longer or shorter pole). Pole 38 can be made from a variety of materials and be a variety of lengths and sizes and can be telescopically-adjustable or fixed in length.

Another embodiment is shown in FIGS. 4-7. In this embodiment, skimmer 10 is comprised of two generally rectangular wooden side panels 12 and 14 that are approximately 5"×11"×0.75" (height×width×thickness) in size. Side panels 12 and 14 are connected via two wooden cross pieces 16 and 20.

Front cross piece 16 is roughly rectangular in cross section with dimensions of 0.75"×1.5"×22.5" (height×width×length). It is connected towards the lower front of skimmer 10 and extends from one side panel to the other. Back cross piece 20 is a rectangular panel comprised of four pieces—top and bottom horizontal bars 40 and 42 with dimensions of 0.75"×1"×22.5" (height×width×length) and left and right vertical support bars 44 and 46 with dimensions of 2.375"×1"×0.75" (height×width×length). Back cross piece 20 is located towards the back of skimmer 10 and extends from one side panel to the other and is generally perpendicular to net 26. Cross pieces 16 and 20 are attached to side panels 12 and 14 via a connecting mechanism, such as a screw, nail, bolt, rivet, clip, or glue, for example. As discussed above, sides 12 and 14 and cross pieces 16 and 20 can be made from a variety of materials and take a variety of forms.

In this embodiment, skimmer 10 contains two wooden 0.75"×3"×13.5" (height×width×length) elongated flotation devices 22 and 24 located on the bottom of and connected to side panels 12 and 14. These flotation devices can be made from a variety of buoyant materials or combinations of buoyant materials, as discussed above.

A 14"×22.5" (width×length) polyester net 26 (screening medium) runs along the bottom of skimmer 10 and is attached to cross pieces 16 and 20. Net 26 is attached to front cross piece 16 and the bottom of back cross piece 20 via slots with rubber splines. A secondary screening or filtering medium 48 extends from the bottom to the top of back cross piece 20 in order to help trap debris in skimmer 10. In this embodiment, second screening medium 48 is perpendicular to net 26 (meaning that it is roughly at a 90° angle, but it does not have to be precisely 90°). Screening medium 48 could be an additional net, or it could be one or a series of 0.25"-thick porous scouring pads held in a vertical alignment in slots in back cross piece 20. One of ordinary skill in the art would recognize that additional sizes and types of screening or filtering materials, such as geotex tile fabric, screens, nets, or filters, among others could be used for either net 26 or second screening medium 48 and still fall within the scope of the invention.

In order to operate and direct the movement of skimmer 10 in pool or body of water 98, there are two cord attachment points 28 and 30 located in top, front corners of side panels 12 and 14. These cord attachment points are 0.3125" diameter holes offset by 0.75" from the top front corners of side panels 12 and 14. The ends of a 0.25" diameter by 32" long rope (flexible cord) 32 pass through cord attachment points 28 and 30 before coming together at control attachment point 34, which is a spring-loaded clip fastened to the center of rope 32. The ends of rope 32 are tied to cord attachment points 28 and 30 in order to secure the ends of rope 32 to side panels 12 and 14. As discussed above, flexible cord 32 can take a variety of forms and be attached to skimmer 10 in a variety of ways.

Figure 8:
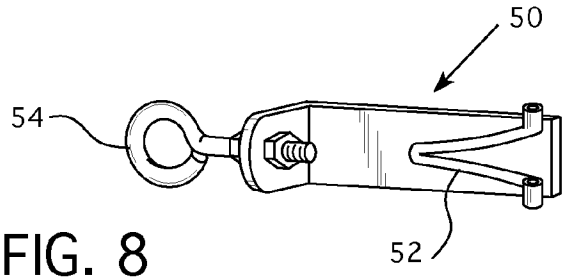
FIG. 8 is a view of an attachment clip.

As shown in FIG. 8, in order to attach pole 38 to skimmer, an adapter 50 fits into the end of pole 38. The end of adapter 50 that fits into pole 38 is comprised of a 0.75" diameter×5" long piece of PVC pipe with plastic spring clips 52 that secure adapter 50 onto pole 38. The other end of adapter 50 is comprised of a 0.25"×1" stainless steel eyebolt 54. A spring-loaded clip 34 attaches to eyebolt 54 in order to attach skimmer 10 to pole 38. As discussed above, other attachment mechanisms can be used.

Figure 4:
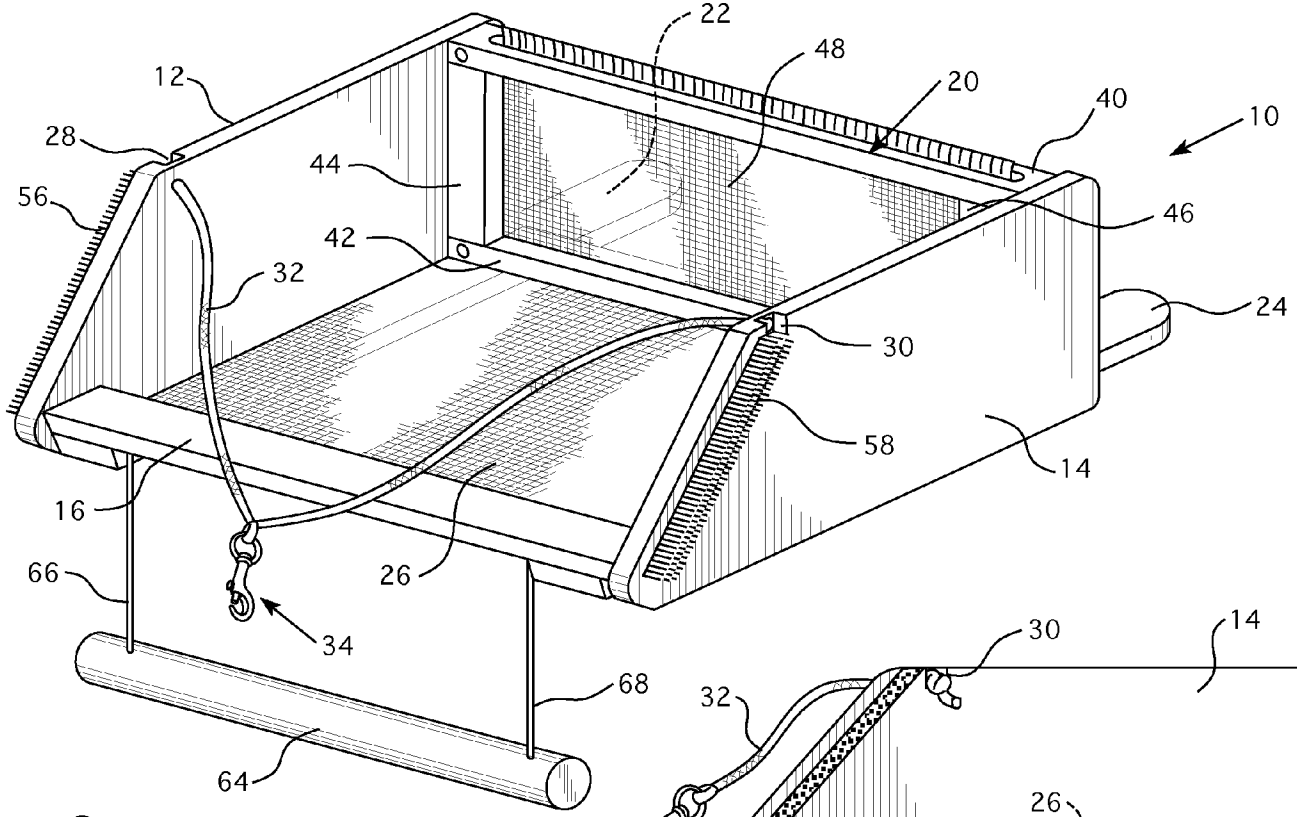
FIG. 4 is a perspective view of another embodiment of the invention.
Figure 6:
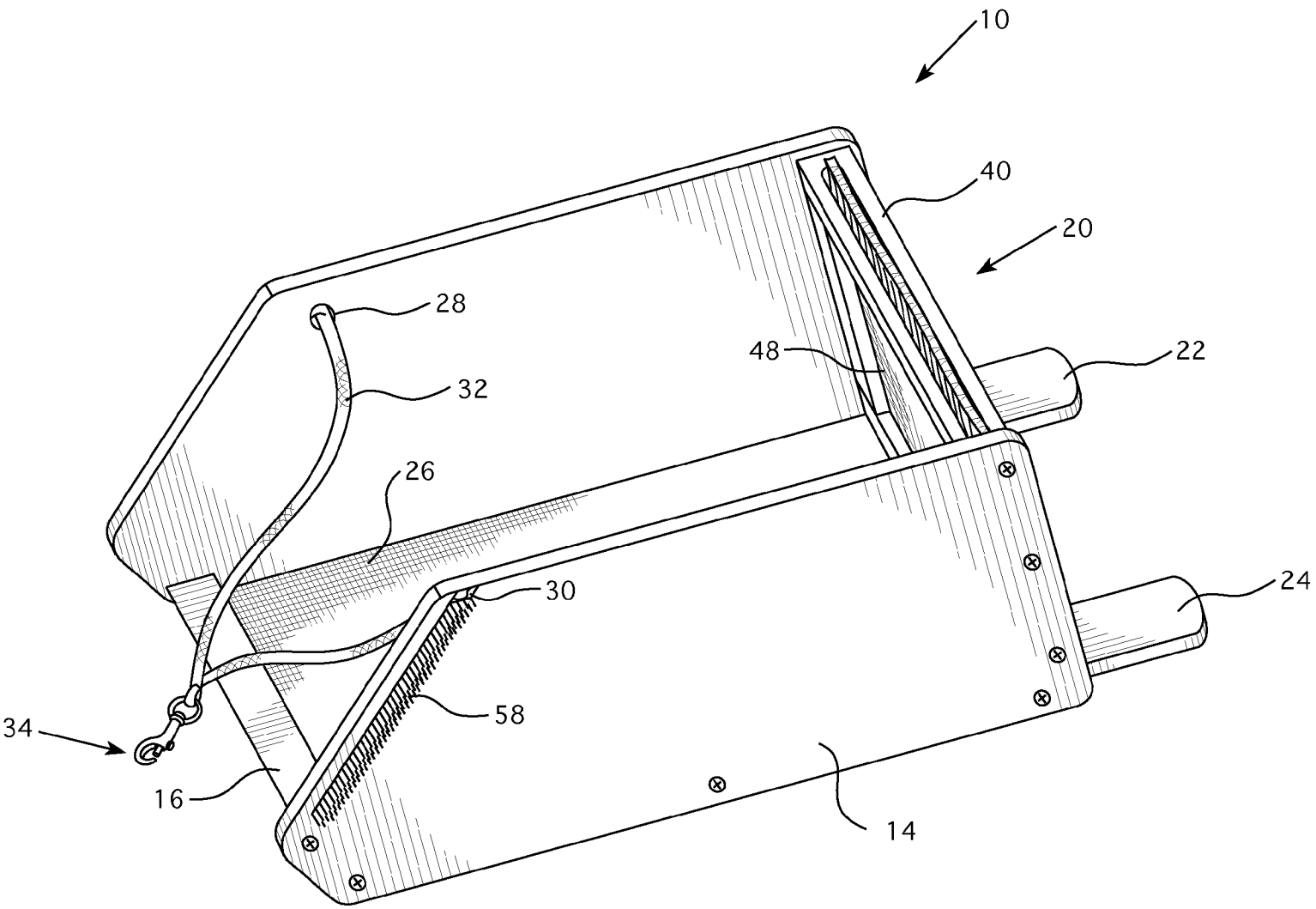
FIG. 6 is another perspective view of another embodiment of the invention.
Figure 7:
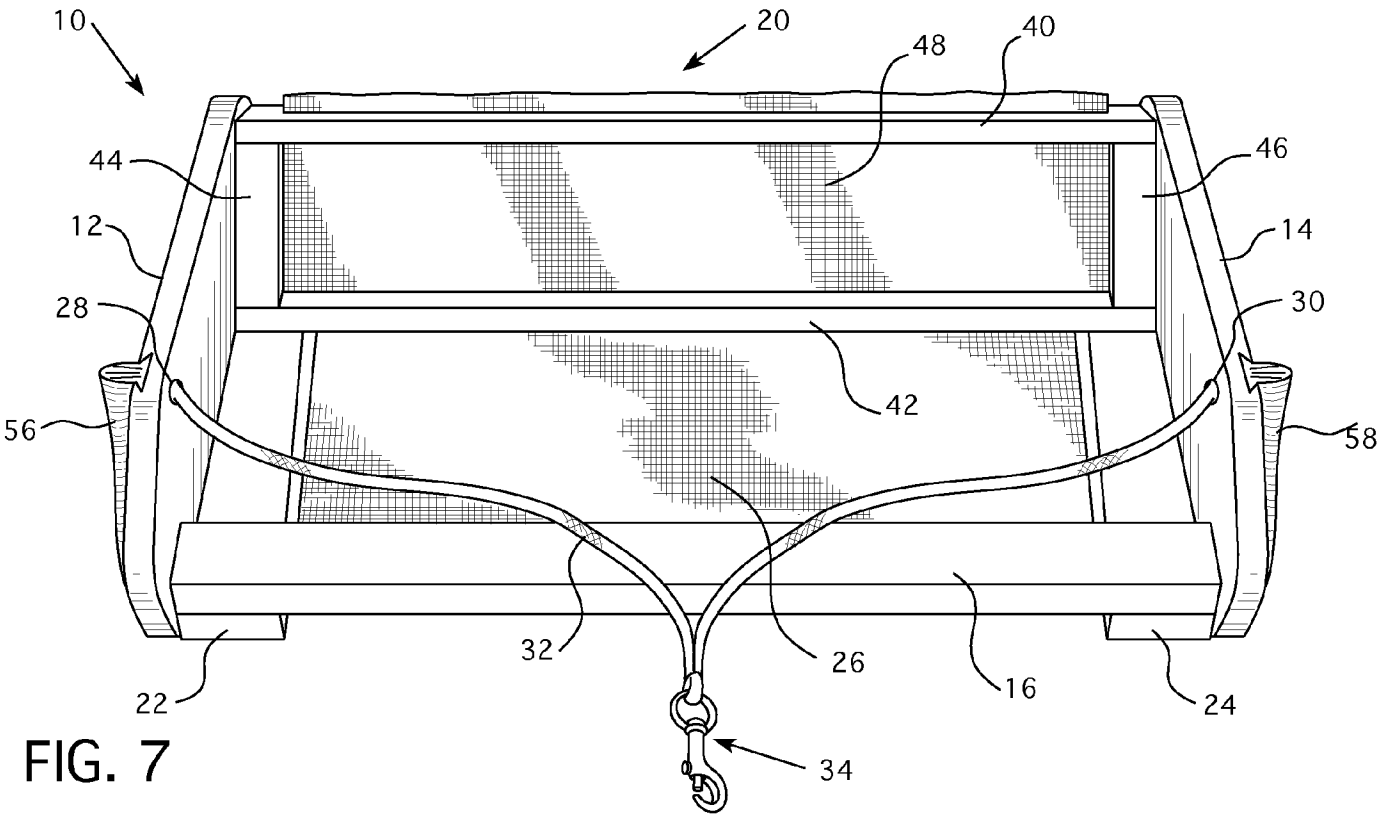
FIG. 7 is a front view of another embodiment of the invention.

In an alternative embodiment, as shown in FIGS. 4, 6, and 7, brushes 56 and 58 can be placed on the sides of skimmer 10 in order to allow easy cleaning of the sides of the pool by rubbing brushes 56 or 58 along the sides or edges of the pool. Some or all of brushes 56 and 58 can be part of skimmer 10. For example, skimmer 10 could only have brushes 56 and 58 on the sides, just brush 56, just brush 58, or brushes in different locations, such as the top, front, or back, in addition to or instead of brushes 56 and 58. In one embodiment, the brushes could be 4"×1"×0.5" in dimension and made of stainless steel, PVC, fabric, or any other common brush material.

In another embodiment, brushes 56 or 58 could be removable, by being screwed, bolted, slotted, snapped, tied, Velcroed, or connected by latches (among other things) into the sides or top of skimmer 10. In this way, the operator could choose when to use or not use the brushes or remove them for easier cleaning.

In still another embodiment shown in FIG. 15, 4"×1"×0.25" fabric pads 104, 106, 108, and 110 can be placed on the corners of skimmer 10 in order to help protect pool 98 from skimmer 10. These pads soften the contact between skimmer 10 and the sides of pool 98 so that skimmer 10 does not scratch or damage pool 98 if skimmer 10 bumps into the sides of pool 98. Other combinations and configurations of pads are possible and can fall within the scope of the invention. For instance, different numbers (more or less) could be used, such as using only pads 104 and 106. Additional pads could be placed along the edge of skimmer 10. A single, long pad could extend along the entire length of side 12 (and a corresponding single pad could extend along the entire length of side 14). These pads can be made from a variety of materials, such as fabric, rubber, plastic, and foam, among other things, and can be attached through a variety of mechanical or chemical means, such as screws, Velcro, or glue, among other things. In addition, brushes 56 and 58 could serve double duty, by acting both as cleaning devices and as pads to protect the pool.

As with the prior embodiment, one of ordinary skill in the art would recognize that the components of this embodiment similarly could be made out of different materials or combinations of materials, made in different dimensions, connected in different manners, or be placed in different configurations and still fall within the scope of the invention.

The skimmer could be made in larger or smaller sizes depending on the needs of the user and the size of the pool being cleaned. Additionally, features from the various embodiments could by combined or varied and still fall within the scope of the invention.

Figure 9:
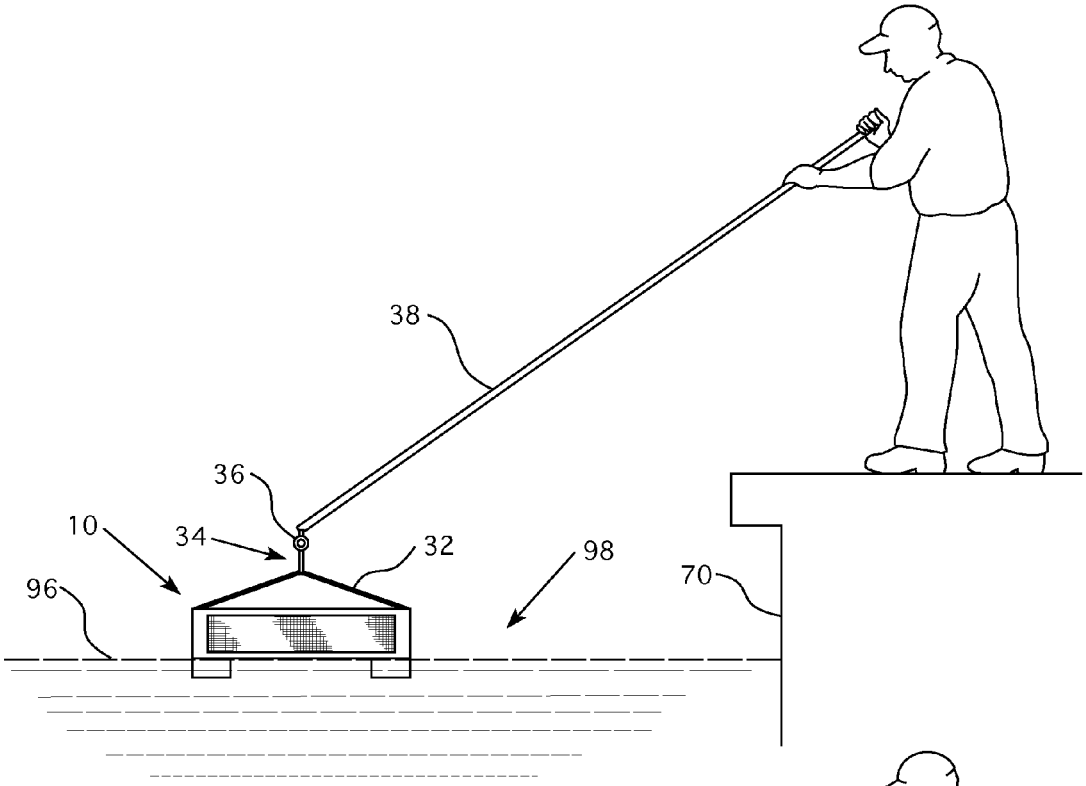
FIG. 9 shows one use of one embodiment of the invention on the surface of a pool.

In order to operate skimmer 10, an operator attaches pole 38 to skimmer 10 via control attachment point 34 and coupling point 36, as shown in FIG. 9. Skimmer 10 is then placed in the water (or, alternatively, the attachment occurs while skimmer 10 is already in the water). Because of the fin-shaped nature of floatation devices 22 and 24 and the coupling of pole 36 towards the front of skimmer 10, as the operator moves pole 38, skimmer 10 will readily follow the end of pole 38. This design allows the operator to readily move skimmer 10 across surface 96 of pool 98 in order to collect debris in net 26. Skimmer 10 will sharply turn in response to the movement of pole 38 due to the change in tension on rope 32.

Figure 10:
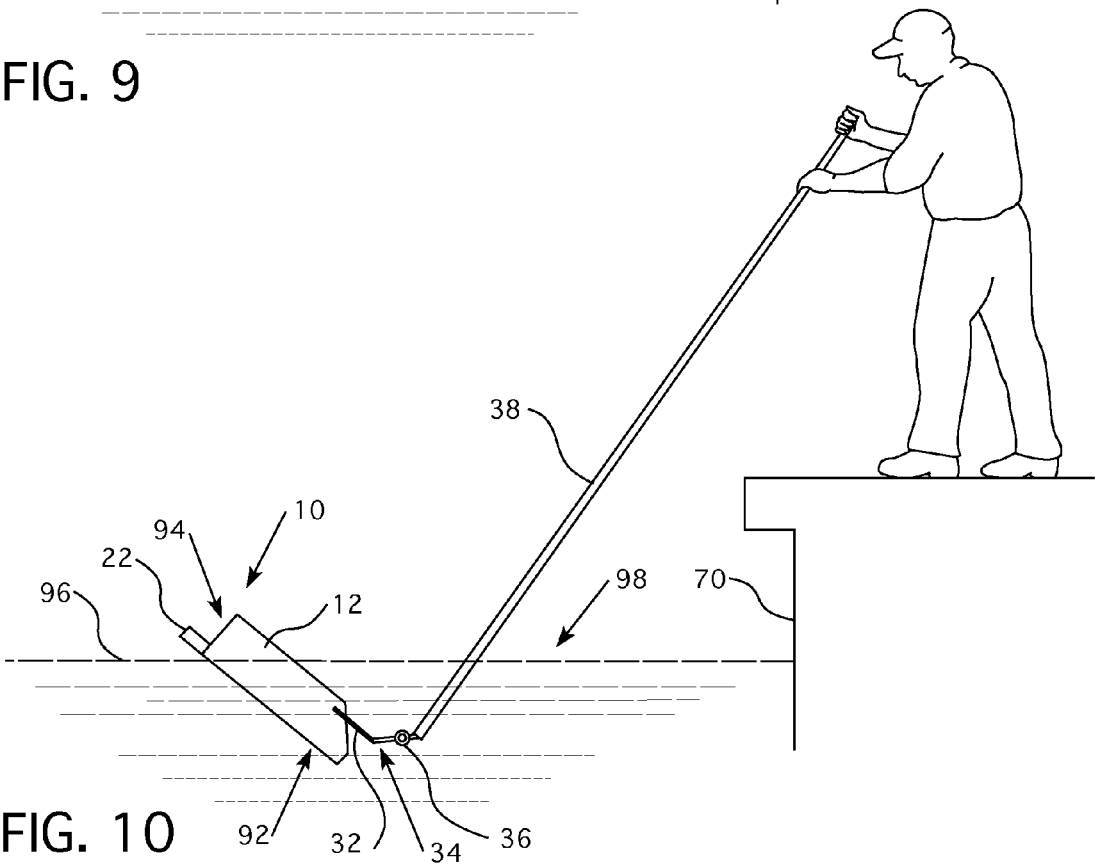
FIG. 10 shows one use of one embodiment of the invention near the surface of a pool.
Figure 11:
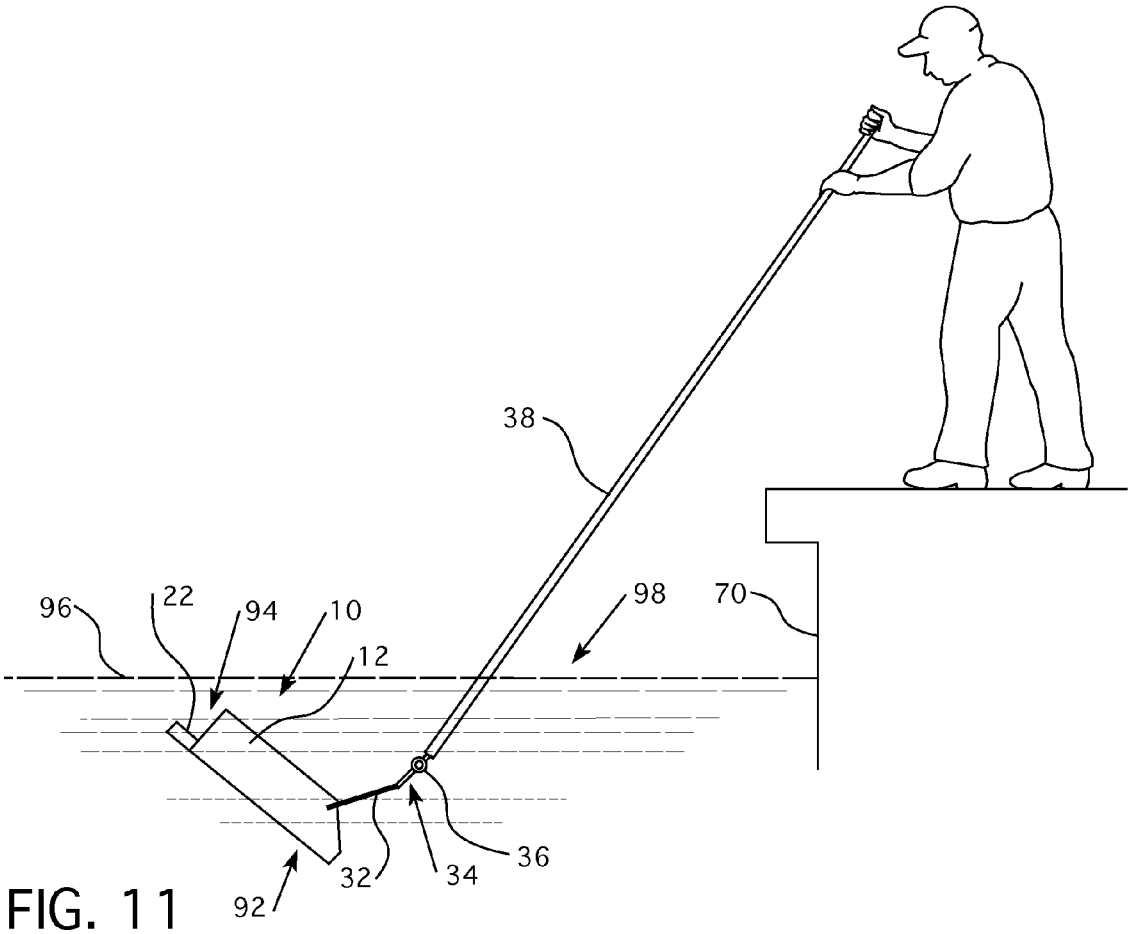
FIG. 11 shows one use of one embodiment of the invention below the surface of a pool.

Occasionally, debris will be floating just below surface 96 of the water. Because rope 32 is closely connected to the end of pole 38 and the front of skimmer 10, the operator can plunge the end of pole 38 under surface 96 of the water and skimmer 10 will follow, as shown in FIGS. 10 and 11. This allows the operator to lower the entrance of the skimmer to below the debris floating under surface 96 and then direct the skimmer back up and out of the water to capture the debris in net 26. The buoyancy of floatation members 22 and 24 (among other things) causes skimmer 10 to float back to the surface 96 of the water once pole 38 is raised. With some practice, an operator can precisely control skimmer 10, including just partially submerging the front of skimmer 10 (FIG. 10) or completely submerging skimmer 10 (FIG. 11). In addition, the operator can pull skimmer 10 backwards along surface 96 of the water 98 without lifting skimmer 10 in order to move skimmer 10 to wherever the operator desires. The high maneuverability of skimmer 10 provides a significant advantage over other prior-art devices, which cannot be as easily moved along the water, moved below the water, and transitioned between the surface of the water and below the water.

Experiments with embodiments of skimmer 10 have shown that there is an optimal range of balance between the buoyancy of front end 92 of skimmer 10 (meaning the forward part of skimmer 10 before cord attachment points 28 and 30) in relation to back end 94 of skimmer 10 (meaning the backward part of skimmer 10 after cord attachment points 28 and 30). In some embodiments, front end 92 of skimmer 10 is almost neutrally buoyant, meaning that only a small amount of force is needed to submerge front end 92 of skimmer 10 below water line 96, whereas back end 94 of skimmer 10 is more buoyant and is more difficult to submerge. In this configuration, the operator can easily submerge front end 92 of skimmer 10 below water line 96 by pushing pole 38 below the water line. As shown in FIG. 10, this allows the operator to collect debris that is floating just below surface 96 with minimal effort, while back end 94 of skimmer 10 (and thus the back end of net 26 and/or secondary screening mechanism 48) remains above water line 96 so that the debris does not flow out of skimmer 10. The exact buoyancy balance required depends on the precise configuration, size, and materials used in skimmer 10.

In other embodiments, the buoyancy of skimmer 10 can be such that the front end of skimmer 10 is still less buoyant than back end 94 of skimmer 10, but the overall buoyancy of skimmer 10 is such that the entire skimmer 10 can be easily submerged under water line 96 when the operator pushes pole 38 below the water line, as shown in FIG. 11. In this configuration, the higher buoyancy of back end 94 of skimmer 10 maintains back end 94 in a more upright position, helps contain the debris in net 26, and facilitates the maneuverability of skimmer 10 under the water. This configuration is more desirable for circumstances in which debris may be present further below the water line than can be reached when just back end 94 of skimmer 10 remains above water.

In general, it is desirable to have the buoyancy of front end 92 be less than the buoyancy of back end 94 so that back end 94 will be preferentially inclined to remain closer to water line 96 than front end 92 when skimmer 10 is in operation (especially when it is used below the surface of the water). The front-back buoyancy balance of skimmer 10 can be adjusted in a variety of ways. For example, material could be added or removed from the front and back ends, more or less dense materials could be used in the front and back ends, the location of cord attachment points 28 and 30 could be shifted forwards or backwards in skimmer 10, or the configuration of the components of skimmer 10 could be adjusted, among other things.

In these disclosed embodiments, the length of rope 32 is less the twice the separation distance between side panels 12 and 14 in order to facilitate the movement of skimmer 10, although the precise length could be different. If rope 32 is too long, it is more difficult to control skimmer 10, and it requires greater movement of pole 38 in order to turn skimmer 10 or to cause it to descend under the water. The length of rope 32 could be between one and three times the separation distance between side panels 12 and 14 for optimal operations, although the shorter end of the range has been found to be more desirable in most circumstances.

Figure 12:
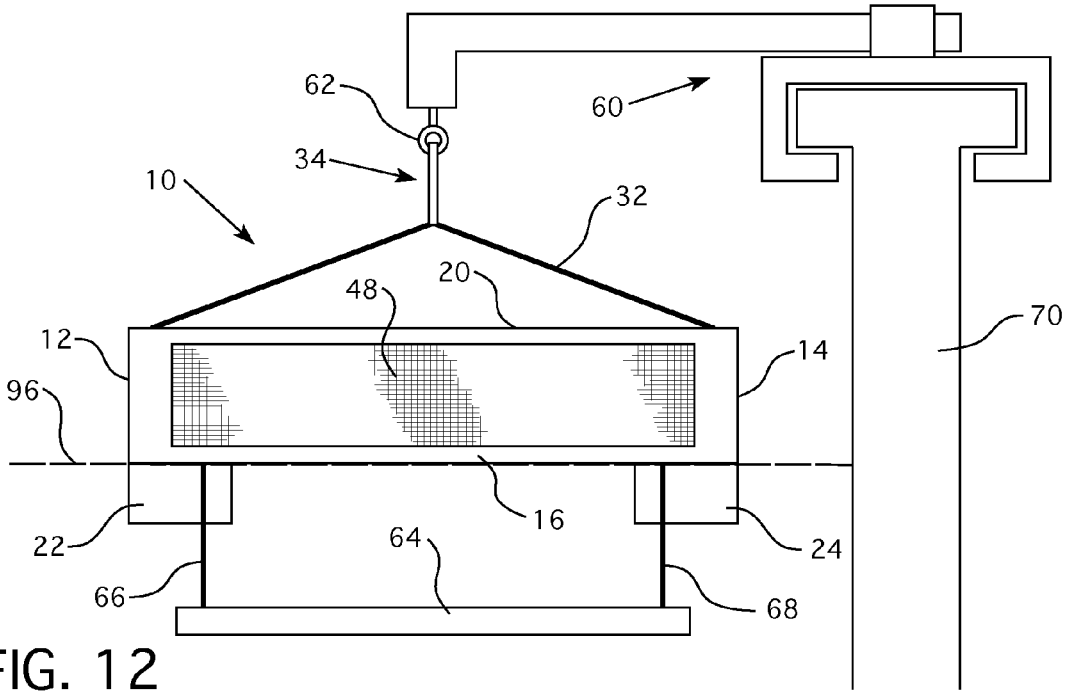
FIG. 12 shows one embodiment of the invention attached to the side of a pool.
Figure 13:
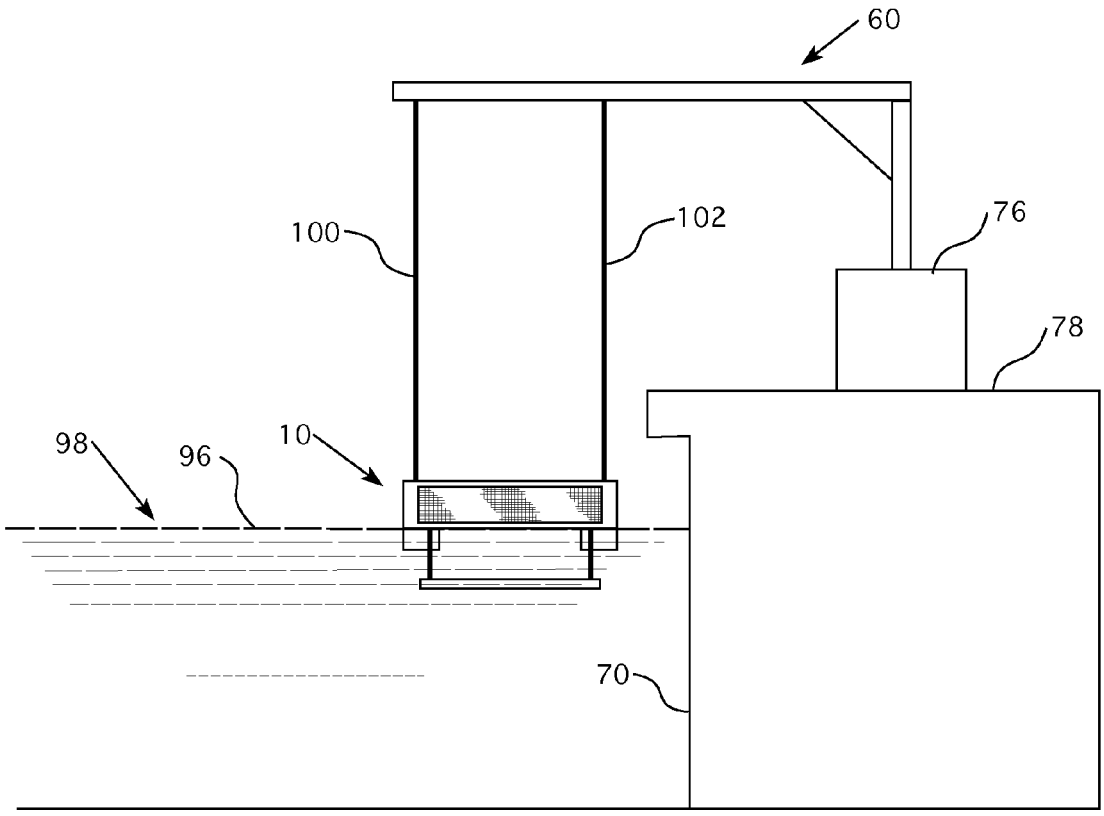
FIG. 13 shows one embodiment of the invention attached to a stand beside a pool.

In yet another embodiment of the invention, shown in FIGS. 12-13, skimmer 10 can be attached to side 70 of pool 98 by attaching it to bracket 60. In one embodiment shown in FIG. 12, bracket 60 attaches to skimmer 10 via coupling point 62 and control attachment point 34. Coupling point 62 can take a variety of forms, such as an eyelet, loop, hook, carabiner, string, chain, and rope, among other things. Alternatively, as shown in FIG. 13, bracket 60 can be attached to skimmer 10 via attachment members 100 and 102 (in one example, rope) that tie to the top of skimmer 10. For example, one end of rope 100 can be tied to the top of the front end 84 of side piece 12, which then loops up to and through bracket 60, and then the other end of rope 100 can be tied to the top of the back end 86 of side piece 12 (and the same is true for rope 102 and side 14). Other types of attachment members are also possible, including, for example, (1) using four ropes that attach to sides 12 and 14 and bracket 60, (2) using rigid members (e.g., wooden, metal, or plastic shafts or rods, among other things) that connect into or are fixed to side pieces 12 and 14, or (3) using rigid members that are integral with side pieces 12 and 14, among other things. Other materials besides rope could also be used, such as chain, cord, string, or wire, among other things. Thus, attachment members 100 and 102 can be comprised of a variety of flexible or rigid connectors or combination of these flexible or rigid connectors in order to connect skimmer 10 to bracket 60.

Figure 14:
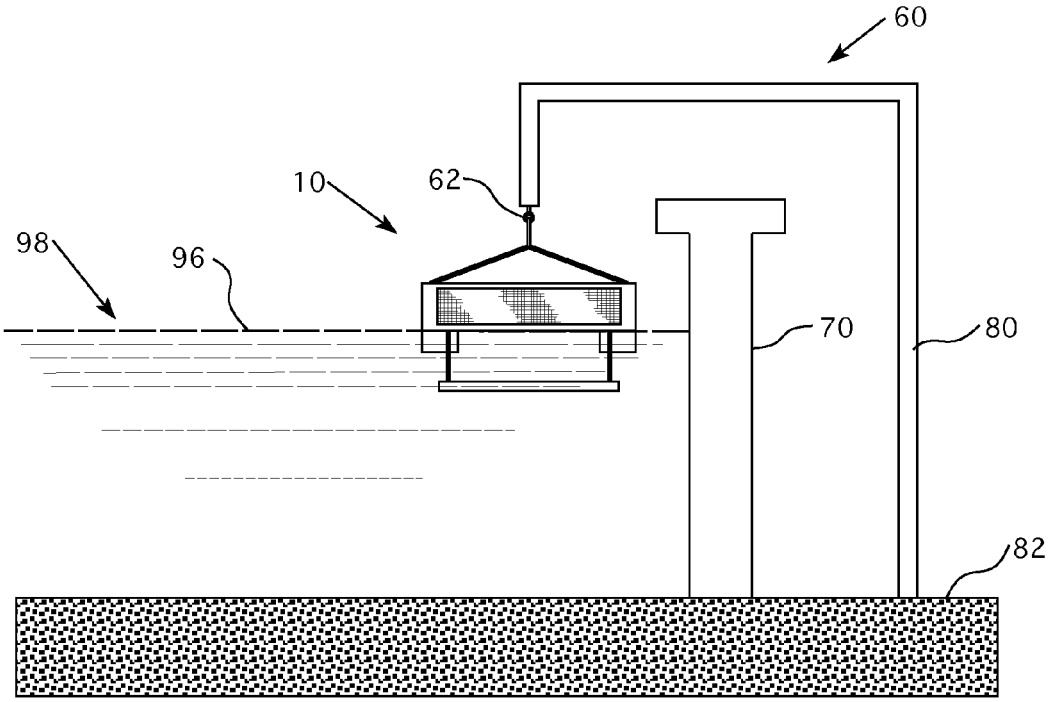
FIG. 14 shows one embodiment of the invention attached to a pole/stake beside a pool.

As shown in FIG. 12, bracket 60 can be either permanently fixed to side 70 of pool 98 or can be temporarily attached/fixed to pool 98 via a clamp, slot, hole, bolt, mounting panel, or other types of attachment mechanisms. As shown in FIGS. 13 and 14, bracket 60 could even be attached to or part of a heavily weighted object or stand 76 that rests on the surface 78 of a pool deck or the ground next to the pool or attached to or part of a long stake, post, or pole 80 that is sunk into or affixed to the ground 82 beside pool 98. Bracket 60 could be integral with post 80, such as being a part of a curved or L-shaped post with coupling point 62 at its one end, or a piece separate from (but connected to) stand 76 or post 80. Bracket 60 can take on a variety of forms and be fixed in a variety of other manners such that it can support and restrain the movement skimmer 10 and still fall within the scope of the invention.

By fixing skimmer 10 to bracket 60, the pool can be cleaned without operator intervention. As debris floats into skimmer 10, the debris will be caught in skimmer 10 to be removed later by an operator or individual. Skimmer 10 can also be designed such that it can function on the end of pole 38 or be removed and connected to bracket 60. This versatility is advantageous because an operator can use skimmer 10 to manually clean a pool and then, when finished, connect skimmer 10 to bracket 60 to continue cleaning the pool while the operator is away instead of having to purchase two separate skimming devices.

Figure 5:
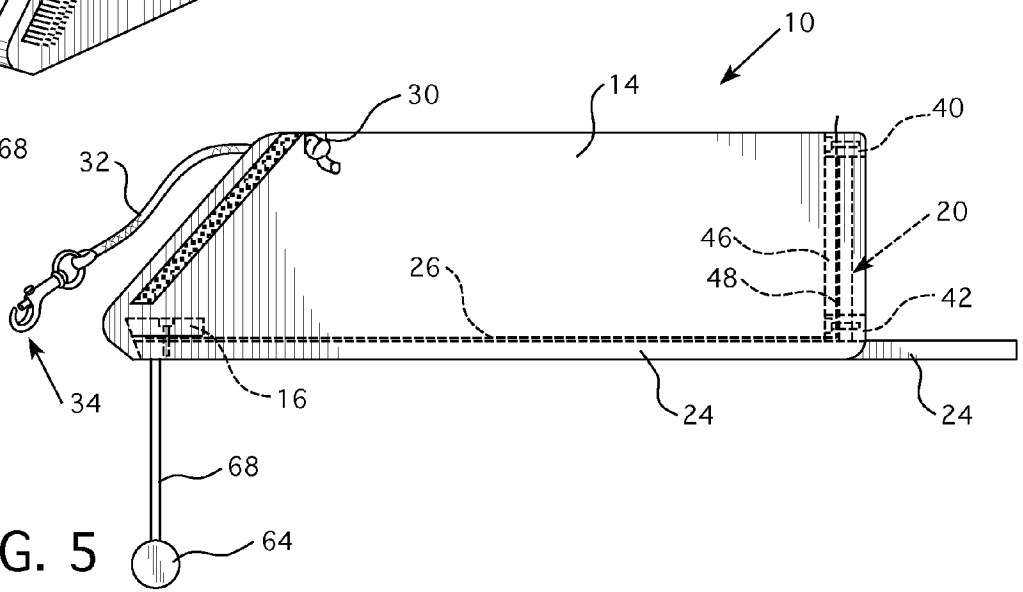
FIG. 5 is a side view of another embodiment of the invention.

In still another embodiment of the invention, as shown in FIGS. 4, 5, and 12, sinker bar 64 can be attached to the front of skimmer 10 and is generally parallel to front cross piece 16. Sinker bar 64 is especially useful for embodiments that are fixed to or beside the side of the pool. As water flows past sinker bar 64, it creates resistance in the water that effectively reduces the buoyancy of front end 92 and causes front end 92 to dip down into the water, which facilitates the debris being captured by effectively by skimmer 10. In this circumstance, front end 92 of skimmer 10 would be below the water, while back end 94 of skimmer 10 would remain above water. As the water stops flowing past sinker bar 64, front end 92 of skimmer 10 would rise back up above water line 96. Debris that floats into skimmer 10 would then be trapped.

Sinker bar 64 can be made of a variety of materials that are denser than water. Sinker bar 64 should be designed in such a way so as to sink front end 92 of skimmer 10 below surface 96 of the water when water flows past skimmer 10/sinker bar 64, but not be so heavy that it will cause skimmer 10 to sink or the front of skimmer 10 to remain below the water when there is no water flowing past skimmer 10/sinker bar 64. The precise density/weight required will depend on the weight, size, and configuration of skimmer 10 and sinker bar 64, among other things.

In one embodiment, sinker bar 64 is made of a 20" long×1" diameter hollow PVC rod that is attached to front cross piece 16 via cords 66 and 68 that tie to two sides of front cross piece 16 and two ends of sinker bar 64. Other materials, dimensions, and attachment mechanisms can be used and fall within the scope of the invention. For instance, sinker bar 64 could be attached to front cross piece 16 by rope, chain, or wire that passes through the middle of sinker bar 64. Sinker bar 64 could also be attached to other parts of skimmer 10, such as the front ends of side panels 12 and 14. Instead of being tied to front cross piece 16, sinker bar 64 could be attached by screws, bolts, slots, snaps, Velcro, or latches, among other things. Sinker bar 64 could also be made of other materials or combinations of materials, such as metal, rubber, or weighted or high-density plastic tubes, among other things. Sinker bar 64 could be permanently attached to skimmer 10, or it could be a removable attachment. For example, sinker bar 64 could be attached to side panels 12 and 14 (or front cross piece 16) using spring-loaded clips, rope that can be untied, snaps, Velcro, or other types of removable securing mechanisms.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. An apparatus for collecting debris near a surface of a pool, comprising:

a first side with a first front end and a first back end;

a second side with a second front end and a second back end, wherein the second side is generally parallel to the first side;

a front cross piece extending from the first front end to the second front end;

a back cross piece extending from the first back end to the second back end;

a flexible cord with a first cord end and a second cord end, wherein the first cord end is connected to the first side at a first cord attachment point that is closer to the first front end than the first back end and wherein the second cord end is connected to the second side at a second cord attachment point that is closer to the second front end than the second back end and wherein the length of the flexible cord is less than three times the distance between the first side and the second side;

an apparatus front end comprised of a front portion of the apparatus extending between the first and second front ends and the first and second cord attachment points;

an apparatus back end comprised of a back portion of the apparatus extending between the first and second cord attachment points and the first and second back ends;

a first elongated floatation device extending from the apparatus front end to the apparatus back end;

a second elongated floatation device extending from the apparatus front end to the apparatus back end;

a first screening medium extending from the apparatus front end to the apparatus back end;

a control attachment point located on the flexible cord; and wherein the buoyancy of the apparatus front end is less than the buoyancy of the apparatus back end.

2. The apparatus of claim 1, wherein the first elongated floatation device and the second elongated flotation device do not extend in front of the front cross piece.

3. The apparatus of claim 1, wherein the first screening medium is comprised of one of a net, a screen, and a strainer.

4. The apparatus of claim 1, wherein the first screening medium is removable from the apparatus.

5. The apparatus of claim 1, wherein the first screening medium is connected to the front cross piece and the back cross piece.

6. The apparatus of claim 1, wherein the flexible cord is comprised of one of a rope, a wire, and a chain.

7. The apparatus of claim 1, wherein the control attachment point is located in the middle of the flexible cord.

8. The apparatus of claim 1, wherein the control attachment point is comprised of one of a hook, a loop, a ring, an eyelet, and a clip.

9. The apparatus of claim 1, further comprising a sinker bar parallel to the front cross piece and connected to the apparatus front end.

10. The apparatus of claim 9, wherein the sinker bar is removable from the apparatus.

11. The apparatus of claim 1, further comprising a first brush attached to the first side.

12. The apparatus of claim 11, wherein the first brush is removable from the apparatus.

13. The apparatus of claim 11, further comprising a second brush attached to the second side.

14. The apparatus of claim 13, wherein the second brush is removable from the apparatus.

15. The apparatus of claim 1, further comprising a first pad located on the first side.

16. The apparatus of claim 15, further comprising a second pad located on the second side.

17. The apparatus of claim 1, further comprising a second screening medium located at the apparatus back end, wherein the second screening medium is generally parallel to the back cross piece.

18. The apparatus of claim 17, wherein the second screening medium is removable from the apparatus.

19. The apparatus of claim 1, further comprising a pole connected to the control attachment point.

20. The apparatus of claim 1, further comprising a bracket connected to the control attachment point.

21. The apparatus of claim 20, wherein the bracket is adapted to be connected to one of a side of the pool, a stand, a pole, a post, and a stake.

22. An apparatus for collecting debris near a surface of a pool, comprising:

a first side with a first front end and a first back end;

a second side with a second front end and a second back end, wherein the second side is generally parallel to the first side;

a front cross piece extending from the first front end to the second front end;

a back cross piece extending from the first back end to the second back end;

an apparatus front end comprised of the first front end, the second front end, and the front cross piece;

an apparatus back end comprised of the first back end, the second back end, and the back cross piece;

a first elongated floatation device extending from the apparatus front end to the apparatus back end;

a second elongated floatation device extending from the apparatus front end to the apparatus back end;

a first screening medium extending from the apparatus front end to the apparatus back end;

a sinker bar parallel to the front cross piece and connected to the apparatus front end;

a first attachment member connected to the first side;

a second attachment member connected to the second side; and a bracket connected to the first attachment member and the second attachment member.

23. The apparatus of claim 22, further comprising a second screening medium located at the apparatus back end, wherein the second screening medium is generally parallel to the back cross piece.

24. The apparatus of claim 23, wherein the second screening medium is removable from the apparatus.

25. The apparatus of claim 22, wherein the bracket is adapted to be connected to one of a side of the pool, a stand, a pole, a post, and a stake.

26. The apparatus of claim 22, further comprising a first pad located on the first side.

27. The apparatus of claim 26, further comprising a second pad located on the second side.

* * * * *